US012780359B1

(12) United States Patent
Farrell et al.

(10) Patent No.: US 12,780,359 B1
(45) Date of Patent: Nov. 3, 2026

(54) MARINE VESSELS AND SYSTEMS CONFIGURED FOR REMOVABLY COUPLING POWER SOURCES

(71) Applicant: Brunswick Corporation, Mettawa, IL (US)

(72) Inventors: Kevin T. Farrell, Port Orange, FL (US); Paul E. Olvera, Edgewater, FL (US); Troy J. Kollmann, New Smyrna Beach, FL (US)

(73) Assignee: Brunswick Corporation, Mettawa, IL (US)

( * ) Notice: Subject to any disclaimer, the term of this patent is extended or adjusted under 35 U.S.C. 154(b) by 297 days.

(21) Appl. No.: 18/617,208

(22) Filed: Mar. 26, 2024

(51) Int. Cl.
*B63B 17/00* (2006.01)

(52) U.S. Cl.
CPC ..... *B63B 17/00* (2013.01); *B63B 2209/18* (2013.01)

(58) Field of Classification Search
CPC ..... B63B 17/00; B63B 2209/18
See application file for complete search history.

(56) References Cited

U.S. PATENT DOCUMENTS 4,553,037 A * 11/1985 Veazey ..... F03D 13/25 290/55
5,507,943 A * 4/1996 Labrador ..... B64C 31/04 210/259
6,209,477 B1 * 4/2001 Biedenweg ..... B60J 7/1282 114/361
9,090,321 B1 7/2015 Casperson
9,362,838 B1 * 6/2016 Balogh ..... B60L 1/00
11,518,261 B2 * 12/2022 Gonring ..... B60L 53/50
11,764,726 B1 9/2023 Wynn
11,884,176 B1 1/2024 Gonring
2008/0190476 A1 8/2008 Baruh
2010/0065104 A1 3/2010 Baruh
2016/0336467 A1 11/2016 Janet
2018/0212432 A1 7/2018 Byrnes
(Continued)

FOREIGN PATENT DOCUMENTS

CN 113320654 A * 8/2021 ..... B63B 17/00
CN 117842293 A * 4/2024 ..... B60L 53/50
(Continued)

OTHER PUBLICATIONS

"Volt Safe Marine" accessed from https://www.voltsafemarine.com/ on Feb. 26, 2024.
(Continued)

*Primary Examiner* — S. Joseph Morano
*Assistant Examiner* — Jovon E Hayes
(74) *Attorney, Agent, or Firm* — Andrus Intellectual Property Law, LLP

(57) ABSTRACT

A marine vessel is configured for removably magnetically coupling a power source thereto, the power source being configured to generate electrical power. The marine vessel comprises a power system configured to receive electrical power from the power source when the power source is magnetically coupled to the marine vessel, and a surface configured to support the power source while the power source is magnetically coupled to the marine vessel and providing the electrical power thereto. The power source is removable from the marine vessel a least in part by overcoming the magnetic coupling therebetween.

20 Claims, 10 Drawing Sheets

(56) References Cited

U.S. PATENT DOCUMENTS

| | | | | |
|---|---|---|---|---|
| 2019/0169853 | A1 | 6/2019 | Bai | |
| 2019/0283843 | A1 | 9/2019 | Greer | |
| 2019/0386606 | A1 | 12/2019 | Raghunathan | |
| 2020/0385093 | A1* | 12/2020 | Gordon, II | B63B 22/18 |
| 2021/0371064 | A1* | 12/2021 | Boks | B63B 21/04 |
| 2021/0371073 | A1 | 12/2021 | Pascucilla | |
| 2022/0021328 | A1 | 1/2022 | Raghunathan | |
| 2022/0200070 | A1* | 6/2022 | Gonring | H01M 50/579 |
| 2023/0027325 | A1 | 1/2023 | Sizemore, Jr. | |
| 2023/0192240 | A1 | 6/2023 | Ritchel | |
| 2024/0068434 | A1* | 2/2024 | Podhola | F03B 13/18 |

FOREIGN PATENT DOCUMENTS

| | | | | |
|---|---|---|---|---|
| KR | 101389605 | B1 * | 4/2014 | B63B 39/02 |
| KR | 20200068819 | A * | 6/2020 | H02S 10/40 |
| WO | WO-2007062278 | A2 * | 5/2007 | H10F 19/80 |

OTHER PUBLICATIONS

"SC-CW-01F" accessed from https://www.scanstrut.com/marine/charge/qi-wireless/hidden-sc-cw-01/f on Feb. 26, 2024.

"Wireless charging structure and efficiency analysis based on wind-solar hybrid power supply system" accessed from https://www.sciencedirect.com/science/article/pii/S2352484722002621 on Mar. 26, 2024.

2021 SeaChoice Products. (n.d.). accessed from https://www.seachoice.com/wp-content/themes/twentyten/2021SeachoiceProducts/141/ on Feb. 2, 2024.

"Sunreef 60 Eco Surreal Solar Power Breakthrough" accessed from https://sunreef-yachts.com/en/yachts/sunreef-60-eco-surreal-solar-power-breakthrough/ on Mar. 7, 2024.

"100 Watt Hood Solar Panel" accessed from https://www.cascadia4x4.com/products/toyota-land-cruiser-100-series-lexus-lx470-vss-system-100-watt-hood-solar-panel on Mar. 22, 2024.

* cited by examiner

MARINE VESSELS AND SYSTEMS CONFIGURED FOR REMOVABLY COUPLING POWER SOURCES

FIELD

The present disclosure generally relates to electrical power sources for marine vessels, and more particularly to stowable power sources magnetically coupled to a marine vessel.

BACKGROUND

This section includes discussion intended to help understand various aspects of the subject matter presently disclosed below. This discussion should not be interpreted as constituting an admission of prior art.

The following are incorporated herein by reference in entirety.

U.S. Pat. No. 11,518,261 discloses a fast charging station for a marine vessel battery on a marine vessel is provided. The fast charging station includes a dock battery, a charger that is operatively coupled to a power source and the dock battery, and an enclosure located on a dock structure in a body of water. The enclosure is configured to encapsulate the dock battery and the charger. The charger is configured to charge the dock battery using the power source when the marine vessel is not docked to the dock structure. The charger is further configured to charge the marine vessel battery using the power source and the dock battery when the marine vessel is docked to the dock structure.

U.S. Patent Application Publication No. 2021/0371064 discloses a system for a marine vessel includes a peripheral device having an actuator configured to move part of the peripheral device between a retracted position and an extended position. A first serial bus is configured to connect the peripheral device to other peripheral devices. A controller is operatively connected to the actuator and is in signal communication with the first serial bus. A sensor is coupled to the controller via a second serial bus. The controller is configured to activate the actuator to move the part of the peripheral device from the extended position to the retracted position and from the retracted position to the extended position in response to information from the sensor.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

One aspect of the present disclosure generally relates to a marine vessel configured for removably magnetically coupling a power source thereto, the power source being configured to generate electrical power. The marine vessel includes a power system configured to receive electrical power from the power source when the power source is magnetically coupled to the marine vessel. The marine vessel further includes a surface configured to support the power source while the power source is magnetically coupled to the marine vessel and providing the electrical power thereto, wherein the power source is removable from the marine vessel a least in part by overcoming the magnetic coupling therebetween.

In certain examples, the power source is positionally fixed relative to the surface via the magnetic coupling between the power source and the marine vessel.

In certain examples, the power source and the marine vessel include magnetic coils through which the electrical power from the power source is provided to the marine vessel inductively.

In certain examples, at least one of the power source and the surface of the marine vessel includes a magnet configured to positionally fix the power source relative to the surface magnetically.

In certain examples, the magnet is fixed relative to the surface of the marine vessel and remains with the surface when the power source is removed therefrom.

In certain examples, the surface has a recessed section configured to position the power source at least partially therein with the power source is supported by the surface so as to assist in positionally fixing the power source relative to the marine vessel.

In certain examples, the power source includes a solar panel.

In certain examples, the surface includes a hardtop.

In certain examples, the power source is a solar panel configured to be magnetically retained on an upper surface of the hardtop as the magnetic coupling between the power source and the marine vessel.

In certain examples, the surface is non-planar and is configured to support a flexible solar panel as the power source thereon.

In certain examples, the electrical power is provided from the power source to the marine vessel via magnetic induction from the magnetic coupling.

In certain examples, the power source and the marine vessel include magnetic coils, wherein the magnetic coupling includes inductive coupling between the magnetic coils such that the electrical power is provided to the marine vessel therethrough.

In certain examples, the surface includes a rigid material, and wherein the magnetic coil of the marine vessel is at least partially recessed within the rigid material.

In certain examples, the surface has a recessed section configured to position the power source at least partially therein while the power source is supported by the surface so as to assist in aligning the magnetic coils of the power source and the marine vessel, respectively.

In certain examples, the surface is configured to prevent the power source from being supported thereby in a position in which the magnetic coils of the power source and the marine vessel are unaligned with each other.

In certain examples, the power source and the marine vessel are electrically coupled via a connector configured to be magnetically retained in a mated position, and wherein the magnetic coupling includes the connector being magnetically retained in the mated position such that the electrical power is provided from the power source to the marine vessel therethrough.

In certain examples, the marine vessel is configured for positionally fixing the power source relative to the surface non-magnetically.

In certain examples, the power source and the marine vessel have a preferred polarity for being electrically coupled together, and wherein the surface and/or the power source are configured such that when the power source is prevented from being supported by the surface in a position in which the power source would be electrically coupled with the marine vessel in a polarity opposite than the preferred polarity.

Another aspect according to the present disclosure generally relates to a marine vessel configured for removably coupling a solar panel thereto, the solar panel being configured to generate electrical power. The marine vessel includes a hardtop having a magnet and a magnetic coil each fixed relative thereto. The magnet is configured to positionally fix the solar panel to the hardtop such that the magnetic coil of the marine vessel is aligned with a magnetic coil of the solar panel. The electrical power generated by the solar panel is provided to the marine vessel via inductive coupling of the marine vessel and the solar panel when the solar panel is positionally fixed to the hardtop.

Another aspect according to the present disclosure generally relates to a marine vessel with a power system. The marine vessel includes a solar panel having solar cells configured to generate electrical power, the solar panel further having a first induction coil electrically coupled to the solar cells, and a hardtop comprising a rigid upper surface and a second induction coil, the second induction coil being electrically coupled to the power system of the marine vessel, wherein the hardtop is configured to support the solar panel on the upper surface thereof. The hardtop is configured such that when the solar panel is supported on the upper surface the electrical power generated by the solar panel is provided to the power system of the marine vessel via magnetic induction between the first induction coil and the second induction coil.

It should be recognized that the different aspects described throughout this disclosure may be combined in different manners, including those than expressly disclosed in the provided examples, while still constituting an invention accord to the present disclosure. Various other features, objects and advantages of the disclosure will be made apparent from the following description taken together with the drawings.

DETAILED DESCRIPTION

As used herein, unless otherwise limited or defined, discussion of particular directions is provided by example only, with regard to particular embodiments or relevant illustrations. For example, discussion of "top," "bottom," "front," "rear," "left," "right," "horizontal," "vertical," "lateral," and "longitudinal" features and/or relative motion, e.g., movement "up" and "down," is generally intended as a description only of the orientation of such features relative to a reference frame of a particular example or illustration. Correspondingly, for example, a "top" feature may sometimes be disposed below a "bottom" feature (and so on), in some arrangements or embodiments. Additionally or alternatively, embodiments may be arranged in a different orientation such that "top" and "bottom" features are arranged horizontally relative to each other, for example in a "left-to-right" orientation.

Through research and development, the present inventors identified disadvantages and limitations of marine solar panel assemblies presently known in the art, including that known solar panels are configured to be permanently installed on a marine vessel. Because known solar panel assemblies are not designed to be removed, these solar panels cannot, or cannot easily, be removed for storage and/or for protection from adverse environmental conditions. This leads to unnecessary damage and wear that reduces the lifespan and/or effectiveness of the solar panels, resulting in an increased cost and time for maintenance and replacement, increased cost of manufacturing and purchase due to requiring more durable materials, and increase waste for landfills. Furthermore, known marine solar panels require a traditional wired connection with a male and female plug to transfer power. Such connections are susceptible to corrosion and/or other damaging conditions. The present inventors have thus realized a need in the art to provide a solar panel assembly for marine vessels that is easily attached and remove by a user, as needed, and that is electrically connected to the marine vessel via a connection that is not susceptible to environmental wear of the connectors. The present disclosure is a result of these efforts.

As will become apparent, the present disclosure contemplates embodiments in which magnetic coupling is used for quickly, easily, and temporarily deploying a power source on a marine vessel. This coupling can relate to electrical coupling and/or positional coupling. For example, this magnetic coupling can take the form of providing positional fixation of a power source relative to the marine vessel, retaining electrical connections to such power sources, and/or to providing energy transfer via magnetic induction, as discussed further below.

Figure 1:
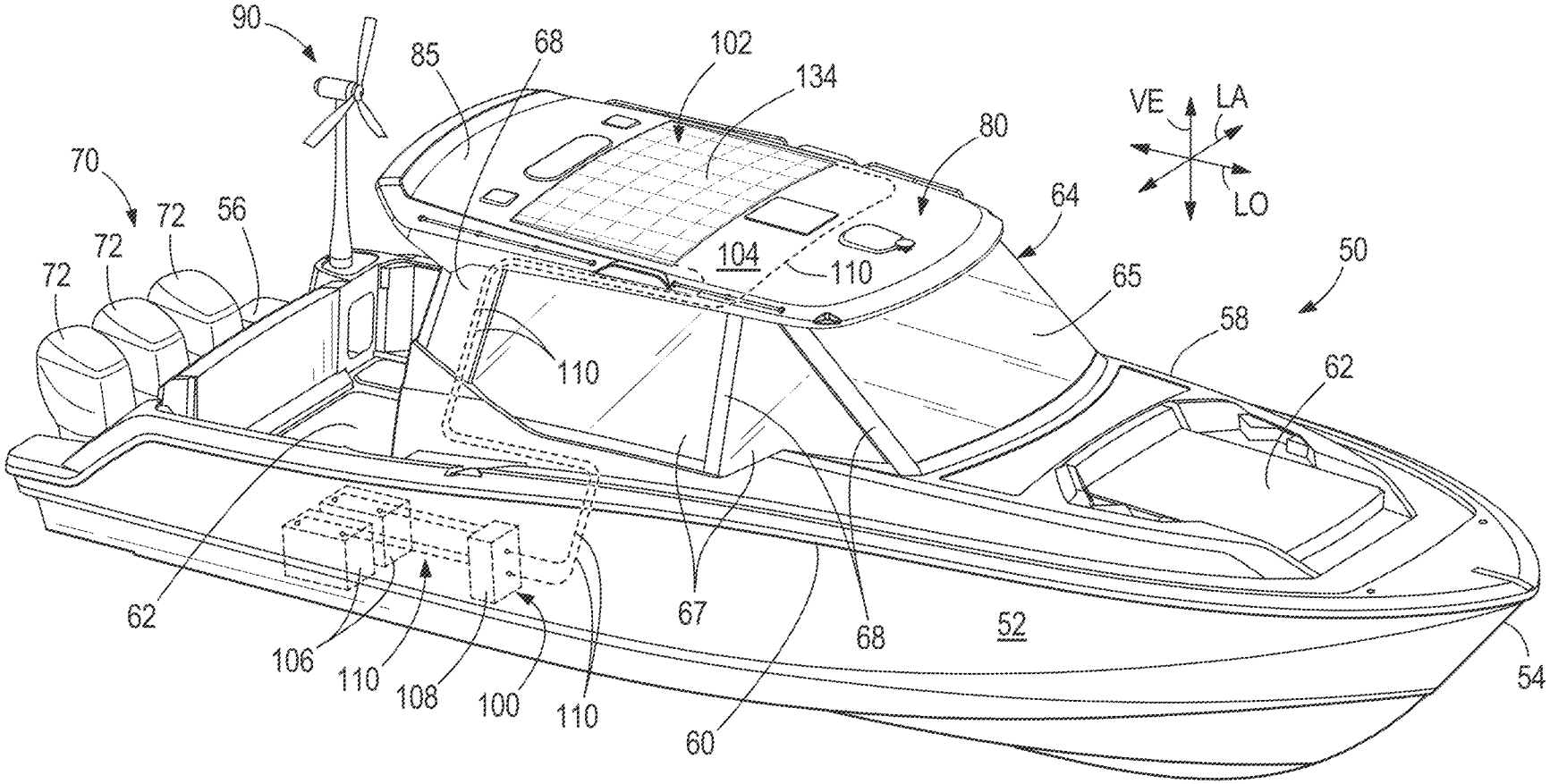
FIG. 1 is a perspective view of an embodiment of a marine vessel according to the present disclosure including a power source that is magnetically coupled to a power system.

FIG. 1 illustrates an embodiment of a marine vessel 50 configured with a novel power system 100 for wirelessly transferring electrical power to the marine vessel 50 from a power source 90, 102. The marine vessel 50 includes a hull 52 that extends from top to bottom in a vertical direction VE, from bow 54 to stern 56 in a longitudinal direction LO that is perpendicular to the vertical direction VE, and from a port side 58 to an opposite starboard side 60 in a lateral direction LA that is perpendicular to the vertical direction VE and perpendicular to the longitudinal direction LO. The marine vessel 50 includes forward and aft decks 62 and a cabin 64 that is at least partially enclosed and includes a helm or operator station (not shown) from which a user may operate the marine vessel 50. The illustrated cabin 64 includes a front windshield 65, lateral windshields 67, a hardtop 80 that covers the top of the cabin 64, and support columns 68 that support the windshields 65, 67 and the hardtop 80.

A propulsion system 70 is mounted at the stern 56 of the marine vessel 50. The propulsion system 70 includes at least one marine drive 72 configured to generate a thrust force to propel the marine vessel 50 through the body of water in which the marine vessel 50 is situated. In the illustrated embodiments, the marine drives 72 are shown as outboard motors mounted on the transom of the marine vessel 50. Some embodiments, however, may include a different number of marine drives 72 and/or at least one marine drive 72 may be a configured as a different type of marine drive 72, such as a stern drive and/or another type of marine drive or marine propulsion device. The marine drives 72 may provide propulsion via electric motors, internal combustion engines, or combinations thereof. The present disclosure also contemplates applications for marine vessels that do not include marine drives for generating propulsion, for example pedal boats, row boats, canoes, kayaks, sailboats, and/or other marine vessels that may accommodate a hardtop, bimini and/or other shade device.

The illustrated marine vessel 50 is configured with a power system 100 configured for removably and magnetically coupling a power source 90, 102 to the marine vessel 50, and to receive electrical power from the power source 90, 102 when it is coupled thereto. In the embodiment of FIG. 1, the marine vessel 50 includes a wind turbine 90 and a solar panel 102 configured as power sources that generate electrical power and supply said power for use in the marine vessel and/or to be stored via at least one battery 106 or other storage system via the power system 100. Some embodiments, however, may be configured with a different number of power sources, and/or at least one power source that is different than the illustrated power sources 90, 102. Additionally or alternatively, a marine vessel 50 may include at least one power source that is in a different position and/or orientation than those of the illustrated embodiments.

It should be recognized that the present disclosure also contemplates configurations in which solar controller systems, battery charging control systems and/or battery management systems are electrically coupled between the solar panel and the one or more batteries. For example, as illustrated in FIG. 1, the marine vessel 50 includes a battery management system 108 electrically coupled between two batteries 106 and the wind turbine 90 and solar panel 102. Since solar control systems, battery charging control systems, and/or battery management systems are generally known in the art and available as commercial products (e.g., providing safety features such as fuses and high current protection, providing step changes in voltages, filtering, conversion between power types, frequencies, etc.), further detail regarding these systems is not provided herein. By way of example, SunPower produces a "starter solar kit" that includes a 100 W Flexible Maxeon Solar Panel and a 10A Pulse Width Modulated (PWM) Solar Charge Controller that works with SLA/GEL/LIFEPO4 batteries. Likewise, it should be recognized that different objects such as wind turbines may be physically anchored to the marine vessel in a conventionally manner while still benefiting from the magnetically coupled electrical connections disclosed herein, whether induction based or through mating of physical contacts.

Figure 2:
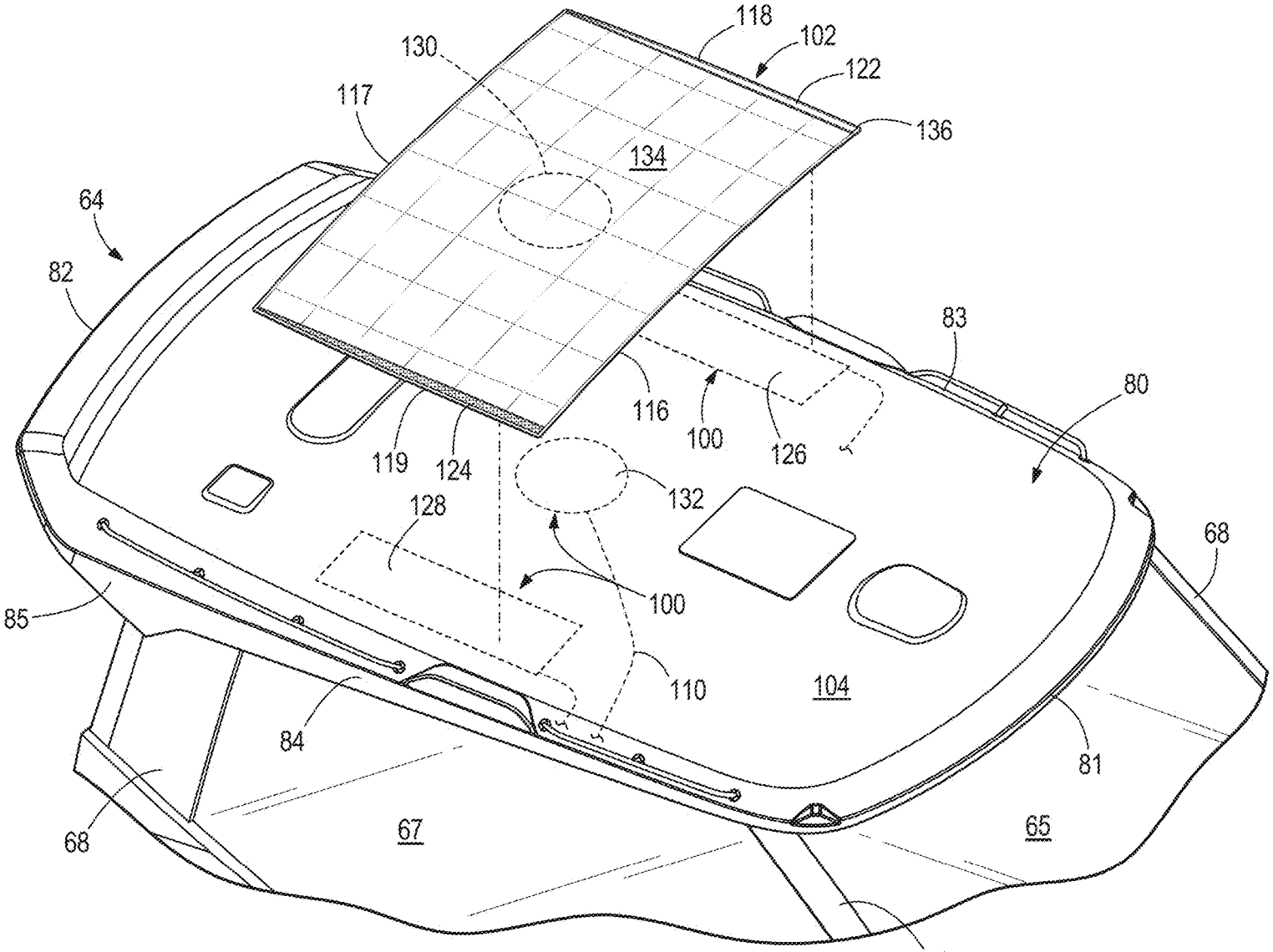
FIG. 2 is an exploded perspective view of the hardtop and solar panel of the marine vessel of FIG. 1.
Figure 3:
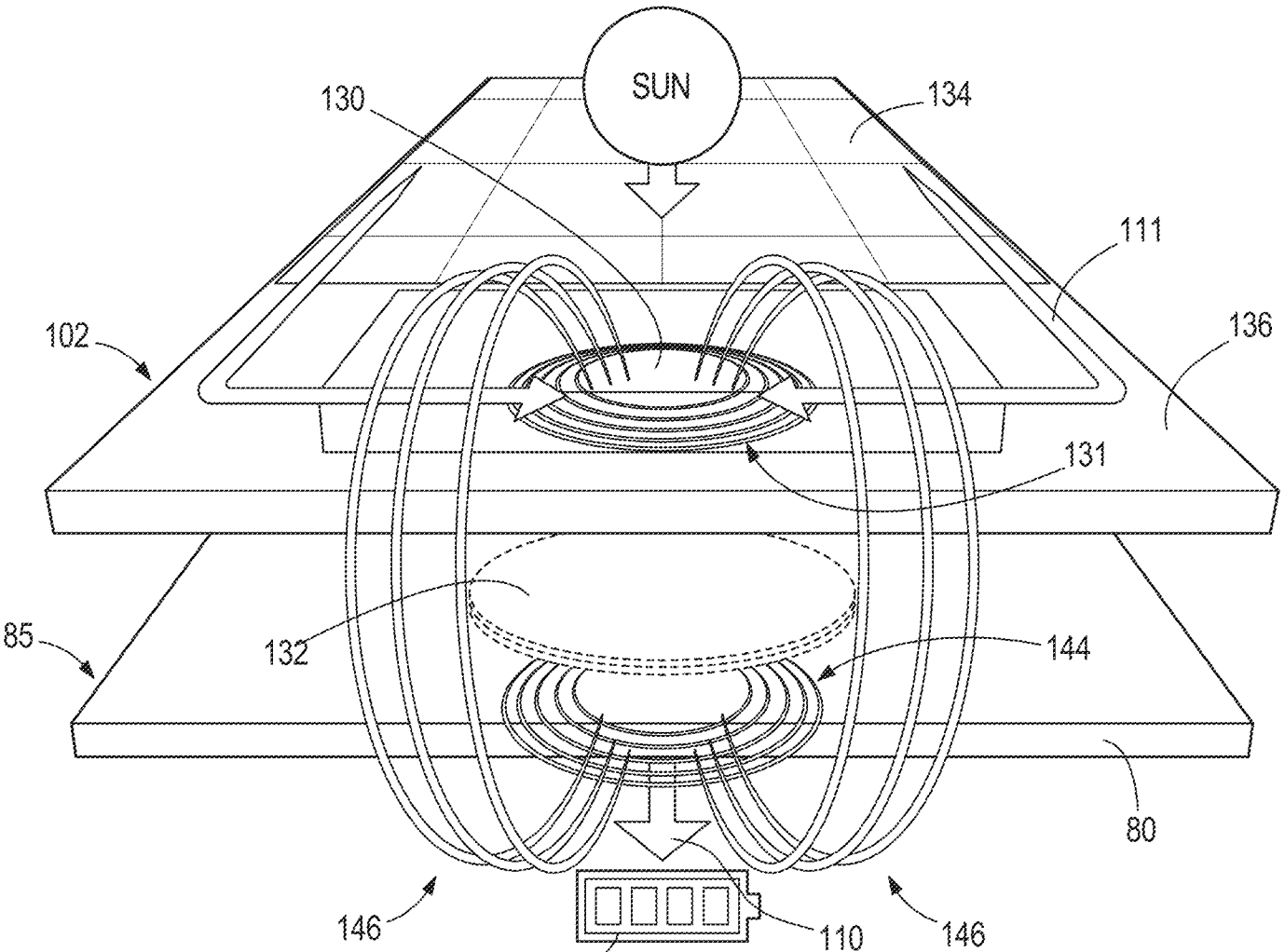
FIG. 3 is an exploded schematic view of the solar panel and receiver coil of the power system of FIG. 1.

Referring to FIGS. 1 and 2, the marine vessel 50 has a solar panel 102 mounted on an upper surface 104 of the hardtop 80. As with the hull 52 of the marine vessel 50, the hardtop 80 includes a body 85 that extends from top to bottom in the vertical direction VE, from a front side 81 to a rear side 82 in the longitudinal direction LO, and from a port side 83 to an opposite starboard side 84 in the lateral direction LA. Some embodiments of a hardtop 80 may be configured with a generally solid body 85, while other embodiments may include a hardtop 80 with at least one section defining an interior cavity (not shown) within the hardtop body 85. The illustrated solar panel 102 is configured as a flexible solar panel 102 that extends longitudinally between a front edge 116 and a rear edge 117 and laterally between opposing port and starboard edges 118, 119. Embodiments of the flexible solar panel 102 may include a flexible substrate 136 with an upward facing, electricity-generating surface 134 (FIG. 3). For example, the solar panel 102 may include at least one flexible solar cell disposed on the surface of the flexible substrate 136. Some embodiments, however, may be include a differently configured solar panel.

The solar panel 102 is configured to be removably secured to the upper surface 104 of the hardtop 80 by a magnetic coupling arrangement. This may be useful, for example, so that the solar panel 102 (or another type of power source) can be removed from the exposed surface 104 of the hardtop 80 to protect the solar panel 102 when it is not in use, thereby preventing damage and overexposure to the elements. Referring to FIG. 2, the illustrated hardtop 80 includes a port side magnet 126 and a starboard side magnet 128 that are configured to magnetically engage the port and starboard edges 118, 119 of the solar panel 102, respectively, thereby positionally fixing the solar panel 102 on the hardtop 80. Port and starboards side orientation indicators 122, 124 formed along the port and starboard edges 118, 119 of the solar panel 102 are configured to assist a user in positioning the solar panel 102 on the hardtop 80, as discussed in further detail below. In some embodiments, the hardtop magnets 126, 128 may be configured to magnetically engage corresponding magnets positioned within the solar panel 102. Some embodiments, however, may include at least one hardtop magnet 126, 128 configured to magnetically engage a ferromagnetic material (e.g., a metal component) within the solar panel 102. The magnets in the hardtop and/or solar panel need not be visible from the surfaces thereof, providing magnetic coupling without impacting aesthetic appearances, without creating gaps or seams to collect debris, etc.

Referring to FIGS. 2 and 3, the magnetic coupling arrangement between the power system 100 in the marine vessel 50 and the solar panel 102 may be configured for wirelessly transferring electrical power to the power system 100. For example, the illustrated solar panel 102 and power system 100 are configured with magnetic coils 130, 132 for wirelessly transferring electrical power from the power source 102 to the power system 100 via inductive power transfer. By way of example, the solar panel 102 may provide power in the range of approximately 300 W, fed at 24V at 25A through the coils 130, 132 to the charge controller. The charge controller may further reduce the voltage down to 14V, for example. An example of commercially available products that may be used for the magnetic coils 130, 132, include the "300 W Wireless Power Reference Design" sold by Microchip Technology of Milwaukee, WI.

FIG. 3 illustrates an exemplary arrangement for providing electrical power from the power source 102 to the marine vessel 50 via inductive power transfer. When the electricity-generating surface 134 of the solar panel 102 is exposed to light, the solar panel 102 generates an electrical current 131 that flow via conductors 111 to and then through a transmitter magnetic coil 130 positioned in the solar panel 102. As per Faraday's law of induction, the flow of electrical current through the transmitter magnetic coil 130 generates a magnetic flux 146 with magnetic field lines that extend axially through the center of the transmitter coil 130. The solar panel 102 is fixed on the body 85 of the hardtop 80 such that the transmitter magnetic coil 130 of the solar panel 102 is coaxially aligned with a receiver coil 132 in the hardtop 80 (e.g., aligned via other position fixing magnets or other mechanisms described below). When the solar panel 102 is positioned on the hardtop 80 as such, the magnetic flux 146 generated by the transmitter coil 130 extends through the center of the receiver magnetic coil 132 positioned within the hardtop body 85. The magnetic flux 146 extending through the receiver coil 132 induces an electrical current 144 to flow through the receiver coil 132, as also described by Faraday's law of induction. Since inductively transferring power via coils is known for other applications, such as charging smartphones via the Qi standard developed by the Wireless Power Consortium, further detail regarding such coils and the functionality therebetween is not provided herein.

The induced electrical current 144 provides electrical power to the marine vessel 50 and is transferred to the battery management system 108 and/or the batteries 106, for example through electrical conductors 110 extending through hardtop 80, support columns 68 (FIG. 1) and/or other portions of the marine vessel 50. Thus, through the transmitter magnetic coil 130 and the receiver magnetic coil 132, the magnetic coupling therebetween provides electrical power from the solar panel 102 to the marine vessel 50. Moreover, this magnetic coupling advantageously provides this electrical coupling between the solar panel 102 and the marine vessel 50 in a manner that is temporary, fast, does not expose elements to corrosion, does not provide any risk of electrical shock, and does not require electrical expertise.

As previously mentioned, the solar panel 102 includes port and starboard side orientation indicators 122, 124 positioned along the port and starboard edges 118, 119 of the solar panel 102. Referring to FIG. 2, the illustrated solar panel 102 includes a port side orientation indictor 122 that extends along the port side edge 118 of the solar panel 102 and a starboard side orientation indictor 124 that extends along the starboard side edge 119 of the solar panel 102. The orientation indicators 122, 124 each provide a visual indicator that may be used to determine how the flexible solar panel 102 should be deployed on the top surface 104 of the hardtop 80. For example, the port side orientation indictor 122 may be a red color to correspond to the red navigation lights on the port side 58 of the marine vessel 50 to indicate that the red orientation indicator 122 should be positioned along the port side 83 of the hardtop 80. Similarly, the starboard side orientation indictor 124 may be a green color to correspond to the green navigation lights on the starboard side of the marine vessel 50 to indicate that the green orientation indicator 124 should be positioned along the starboard side 84 of the hardtop 80. This may be useful, for example, so that the solar panel 102 is positionally fixed on the hardtop 80 with the transmitter and receiver magnetic coils 130, 132 in vertical or coaxial alignment, thereby preventing the solar panel 102 (or another type of power source) from being supported on the hardtop 80 in a position in which the magnetic coils 130, 132 of the solar panel 102 and the marine vessel are unaligned with each other.

Some embodiments of a solar panel 102 (or another power source) may include at least one differently configured orientation indicator 122, 124 to ensure alignment of the magnetic coils 130, 132 and/or the magnets 126, 128 in the hardtop 80 for magnetically coupling the solar panel 102 thereto. For example, an orientation indicator may comprise a pointer arrow which points to the corresponding port or starboard side 83, 84 of the hardtop 80. At least one orientation indicator may indicate which edge 116, 117 of the solar panel 102 should face towards the front side 81 or rear side 82 of the hardtop 80. Additionally or alternatively, some embodiments of a marine vessel 50 may include a hardtop 80 with features to assist in positionally fixing the solar panel 102 in the desired position on the upper surface 104 hardtop 80. For example, a hardtop may be configured with a recess (not shown) configured to receive at least a portion of a power source. The recess may be shaped, sized, and/or positioned on the hardtop 80 such that, when the power source is received therein, the magnets and/or magnetic coils in the hardtop 80 are aligned with those in the power source. This may be useful, for example, in order to prevent the power source from being supported on the upper surface of the hardtop in a position in which said magnets and/or magnetic coils are not in alignment.

In the embodiments of FIGS. 1-3, the transmitter magnetic coil 130 and the receiver magnetic coil 132 are positioned within the body of the solar panel 102 and the body 85 of the hardtop 80, respectively. This arrangement of magnetic coils 130, 132 advantageously enables the transfer of electrical power without requiring any exposed contacts on the upper surface 104 of the hardtop 80 and on the solar panel 102, thereby reducing the potential for wear and/or damage from environmental conditions and external forces acting on the marine vessel 50 or the solar panel 102. Some embodiments, however, may be differently configured. For example, at least one of the marine vessel 50 and the solar panel 102 may be configured with a magnetic coil that is on an exposed surface of the marine vessel 50 or solar panel 102. Additionally or alternatively, the receiver magnetic coil 132 may be at least partially positioned within a recess (not shown) formed in the rigid material of the body 85 of the hardtop 80.

Furthermore, the illustrated port and starboard hardtop magnets 126, 128 are positioned within the body 85 of the hardtop 80 such that they are not exposed on the top surface 104 thereof. This may be useful, for example, to reduce the potential for wear and/or damage from environmental conditions and external forces to the hardtop magnets 126, 128. Some embodiments, however, may include at least one magnet 126, 128 that is at least partially exposed on the hardtop 80. For example, at least one hardtop magnet 126, 128 may be positioned within a recess (not shown) formed in the rigid material of the body 85 of the hardtop 80. These magnets may be coated or covered with different materials to prevent rust and the like.

Referring to FIGS. 1 and 2, the power system 100 of the marine vessel 50 enables a user to connect a removable solar panel 102 on a surface of the marine vessel 50 (e.g., the upper surface 104 of the hardtop 80) to generate electrical power when in use, and to remove the solar panel 102 so that it may be stowed when electrical power generation is not needed. To couple the solar panel 102 to the surface 104, a user observes the port and starboard orientation indicators 122, 124 on the solar panel 102 and uses them to move the solar panel 102 into the desired position in which the transmitter magnetic coil 130 is aligned with the receiver magnetic coil 132, and so that the port and starboard hardtop magnets 126, 128 are aligned with the correct portions of the solar panel 102 to facilitate the magnetic coupling between the hardtop 80 and the solar panel 102. By way of example, magnets used only for fixing accessories, rather than for transmitting power via induction, may comprise neodymium or other types of magnets known in the art. In some embodiments, the flexible solar panel 102 may be a rollable solar panel 102 that may be rolled up into a rolled configuration so that the solar panel 102 may be placed in storage. In such an embodiment, positioning the solar panel 102 on the hardtop 80 may comprise unrolling the solar panel 102 in a lateral direction (i.e., from port side to starboard side or vice versa) or in a longitudinal direction (i.e., from front to back or vice versa). Advantageously, the flexible nature of the solar panel 102 allows it to conform to the upper surface 104 of the hardtop 80, which may generally be planar or nonplanar.

Once the solar panel 102 is positioned on the hardtop 80, an attractive magnetic force between the hardtop magnets 126, 128 and the solar panel 102 provides a magnetic coupling that positionally fixes the solar panel 102 on the upper surface 104. Additionally, the exposed electricity-generating surface 134 of the solar panel 102 generates an electrical current that flows through the transmitter coil 130 in the solar panel 102, thereby generating a magnetic field around the transmitter coil 130. The generated magnetic field extends through the receiver coil 132 in the body 85 of the hardtop 80, thereby inducing an electrical current in the receiver coil 132 and magnetically coupling the two magnetic coils 130, 132 via magnetic induction and transferring power from the solar panel 102 to the power system 100. Because the magnetic coils 130, 132 and the hardtop magnets 126, 128 are positioned within the solar panel 102 or the hardtop body 85, the power system 100 does not include require any exposed contacts for positionally fixing the solar panel 102 or providing power to the marine vessel 50 from the solar panel 102.

To remove the solar panel 102 from the marine vessel 50, for example to store the solar panel 102, the solar panel 102 can be lifted from the upper surface 104 of the hardtop 80 by overcoming the attractive force provided by the magnetic coupling therebetween. Advantageously, the use of a magnetic coupling arrangement enables a user to attach the solar panel 102 to the hardtop 80 and/or remove the solar panel 102 from the hardtop 80 without the use of any tools or exposed fastening devices. When the solar panel 102 is removed from the hardtop 80, the magnets 126, 128 configured to positionally fix the solar panel 102 remain with the body 85 of the hardtop 80 so that the solar panel 102 may be reattached without reconfiguring the hardtop 80, the solar panel 102, and/or the power system 100.

Figure 4:
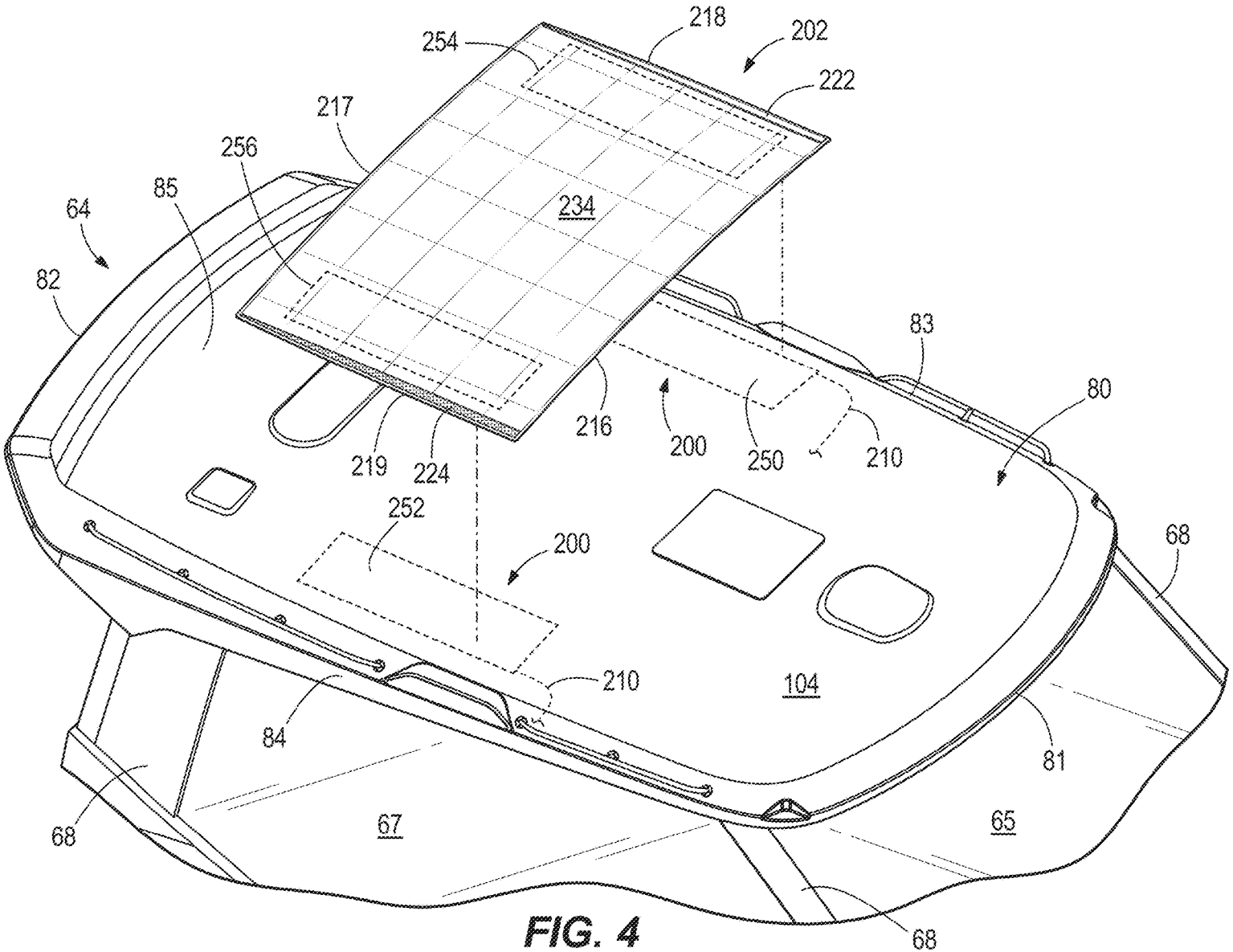
FIG. 4 is a detailed, exploded perspective view of another embodiment of a marine vessel according to the present disclosure including a power source that is magnetically coupled to a power system.

In the embodiments of FIGS. 1-3, the magnetic coupling between the marine vessel 50 and the power source 102 includes magnets 126, 128 positioned within the body 85 of the hardtop 80 to positionally fix the solar panel 102 thereon, as well as corresponding magnetic coils 130, 132 in the solar panel 102 and the hardtop 80 configured for transmitting power from the solar panel 102 to the marine vessel 50 via magnetic induction. Some embodiments, however, may be differently configured. For example, FIG. 4 illustrates an embodiment of a marine vessel 50 comprising a power system 200 with a port and starboard side magnetic coils 250, 252 in the hardtop 80 that are configured to be magnetically coupled to corresponding port and starboard side magnetic coils 254, 256 in the solar panel 102. In the embodiment of FIG. 4, the marine vessel 50 (e.g., the hardtop 80) and other related components thereof are generally the same as those described with respect to FIGS. 1-3 and will not be described again.

Referring to FIG. 4, the power source 202 is configured as a flexible solar panel 202 that extends longitudinally between a front edge 216 and a rear edge 217 and laterally between opposing port and starboard edges 218, 219, and which includes port and starboards side orientation indicators 222, 224 positioned proximate along the respective port and starboard edges 218, 219 of the solar panel 202. As with the embodiments of FIGS. 1-3, the flexible solar panel 202 of FIG. 2 is configured to be supported on the upper surface 104 of the hardtop 80 and positionally fixed thereon relative to the marine vessel 50. However, neither the marine vessel 50 nor the solar panel 202 include magnets for positionally fixing the solar panel 202 on the marine vessel 50 that are separate from those used for inductive power transfer. Rather, the power system 200 of FIG. 2 is configured to couple the solar panel 202 to the hardtop 80 via the magnetic couplings between the each of the transmitter magnetic coils 254, 256 in the solar panel 202 and the corresponding one of the receiver magnetic coils 250, 252 positioned in the body 85 of the hardtop 80.

With continued reference to FIG. 4, the flexible solar panel 202 can be deployed on the upper surface 104 of the hardtop 80 using the port and starboard orientation indicators 222, 224 to ensure alignment between the magnetic coils 250, 252 in the hardtop 80 and the magnetic coils 254, 256 in the solar panel 202. In particular, positioning the solar panel 202 using the port and starboard orientation indicators 222, 224 ensures that the port side transmitter coil 254 in the solar panel 202 is vertically aligned with the port side receiver coil 250 in the hardtop 80, and that the starboard side transmitter coil 256 in the solar panel 202 is vertically aligned with the starboard side receiver coil 252 in the hardtop 80. Thus, the port and starboard orientation indicators 222, 224 advantageously prevents the solar panel 202 from being supported by the hardtop 80 in a position in which the solar panel 202 would be electrically coupled with the marine vessel in a polarity opposite than the preferred polarity of the solar panel 202 and/or the power system 200.

When the solar panel 202 is in the desired position on the hardtop 80 and the electricity-generating surface 234 is exposed to sunlight, an electrical current is generated and flows through the port and starboard transmitter coils 254, 256. As discussed in reference to FIG. 3, the electrical current flowing through the transmitter coils 254, 256 generates a magnetic field that, in turn, induces an electrical current flowing through the receiver magnetic coils 250, 252. Thus, the magnetic coupling between the port side transmitter coil 254 and the port side receiver coil 250 and the magnetic coupling between the starboard side transmitter coil 256 and the starboard side receiver coil 252 inductively transfers electrical power from the solar panel 202 to the power system 200 of the marine vessel 50. The solar panel 202 may then be positionally via additional magnets (e.g., within the upper surface 104 of the hardtop 80), or otherwise fixed with straps, snaps, hook and loop fasteners, and/or the like.

In some embodiments, the attractive magnetic force may act ferromagnetic components of the magnetic coils 250, 252, 254, 256, the marine vessel 50, and/or the solar panel 202. Additionally or alternatively, at least one of the magnetic coils 250, 252, 254, 256 may be configured with a permanent magnet (not shown) positioned proximate the center of said magnetic coil 250, 252, 254, 256. In such an embodiment, the attractive magnetic force between may act between the transmitter coil 254, 256 which is generating the magnetic field and the permanent magnet in the opposing receiver magnetic coil 250, 252, thereby positionally fixing the solar panel 202 on the marine vessel 50. Advantageously, the inclusion of a permanent magnet in a magnetic coil 250, 252, 254, 256 may improve the efficiency of the inductive power transfer by guiding the magnetic field lines generated by the transmitter magnetic coil 254, 256 through the corresponding receiver magnetic coil 250, 252.

In the embodiment of FIG. 4, the flexible solar panel 202 is magnetically coupled to the hardtop 80 by two pairs of transmitter coils 254, 256 and receiver coils 250, 252 proximate the port and starboard edges 218, 219 of the solar panel 202. Some embodiments, however, may be differently configured. For example, a power source may be magnetically coupled to a marine vessel by more than two magnetic coil pairs. Additionally or alternatively, at least one pair of transmitter and receiver magnetic coils may be located in a different position than those of the illustrated embodiments. While the magnetic coils 250, 252, 254, 256 of FIG. 4 are depicted as being generally rectangular, it should be appreciated that some embodiments may include at least one magnetic coil having a different shape and/or size than those of the illustrated embodiments, and/or a combination of magnetic coils and other magnets not used for inductive power transfer being used together for fixing the solar panel to the marine vessel.

Figure 5:
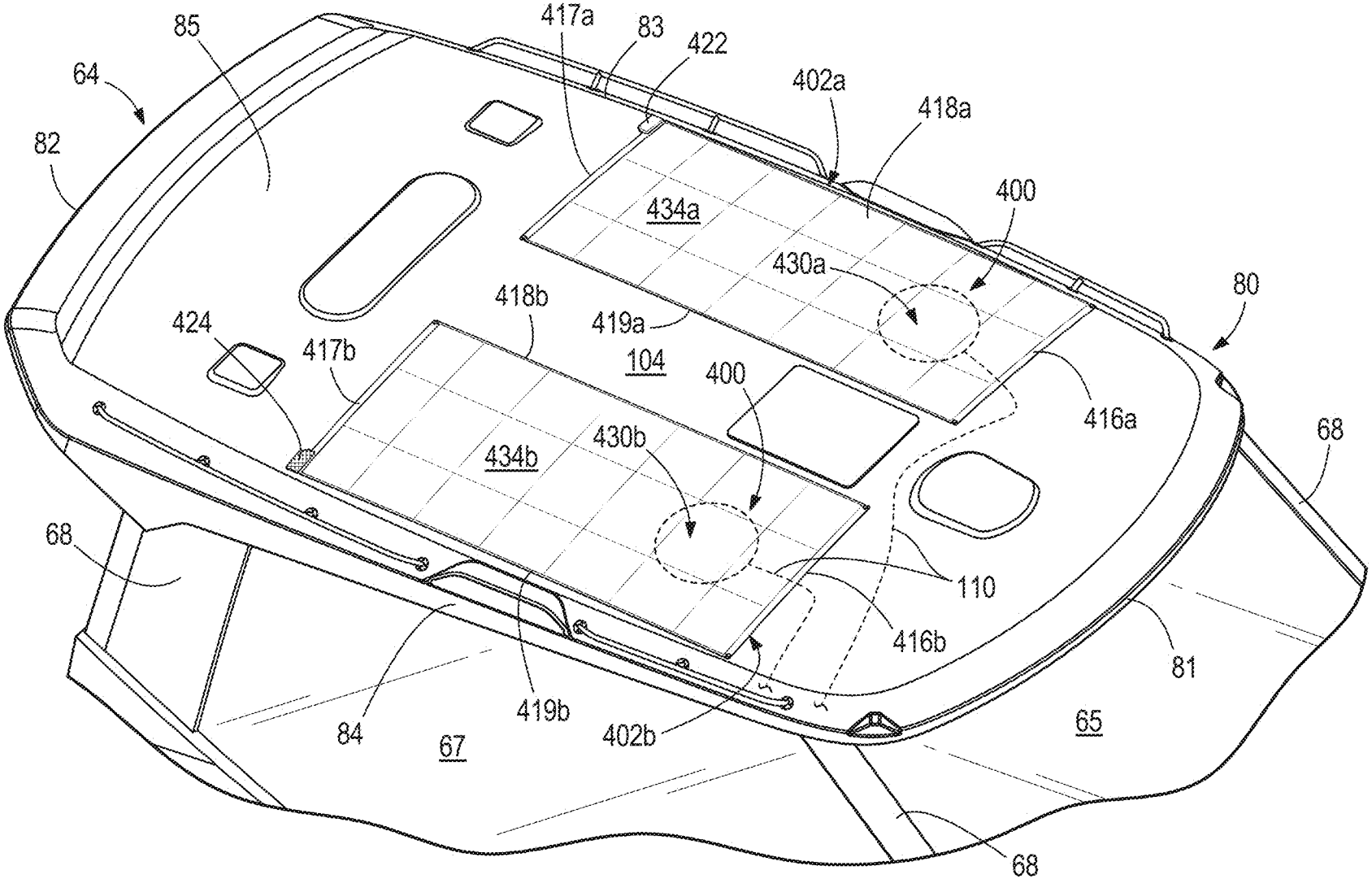
FIG. 5 is a detailed perspective view of another embodiment of a marine vessel according to the present disclosure including multiple power sources that are magnetically coupled to a power system.

In the embodiments of FIGS. 1-4, the marine vessel 50 and the illustrated power systems 100, 200 are configured for use with a single power source 102, 202 mounted on the upper surface 104 of the hardtop 80. Some embodiments, however, may be differently configured. For example, FIG. 5 illustrates and embodiment of a marine vessel 50 configured with two solar panels 402*a*, 402*b* which are positionally fixed relative to the hardtop 80 and configured to inductively provide power to the marine vessel 50 through a magnetic coupling. In the embodiments of FIG. 5, the marine vessel 50 (e.g., the hardtop 80) and other related components thereof are generally the same as those described with respect to FIGS. 1-4 and will not be described again.

Referring to FIG. 5, the illustrated hardtop 80 is configured to support a flexible port side solar panel 402*a* and a flexible starboard side solar panel 402*b* that each extend longitudinally between a front edge 416*a*, 416*b* and a rear edge 417*a*, 417*b* and laterally between a port side edge 418*a*, 418*b* and an opposing starboard side edge 419*a*, 419*b*. The port and starboard side solar panels 402*a*, 402*b* are respectively configured to be positionally fixed on the upper surface 104 of the hardtop 80 proximate the port and starboard sides 83, 84 thereof. Each of the solar panels 402*a*, 402*b* includes an orientation indicator 422, 424 located proximate the rear, laterally outer corner of the solar panels 402*a*, 402*b*. In particular, the illustrated port side solar panel 402*a* includes a port side orientation indicator 422 proximate the corner between the rear edge 417*a* and the port side edge 418*a* thereof and the starboard side solar panel 402*b* includes a starboard side orientation indicator 424 proximate the corner between the rear edge 417*b* and the starboard side edge 419*b* thereof.

As with those of the previously described embodiments, the orientation indicators 422, 424 assist a user in positioning the solar panels 402*a*, 402*b* in their proper positions for the magnetic coupling between the solar panels 402*a*, 402*b* and the power system 400 of the marine vessel 50. For example, as illustrated in FIG. 5, the port side orientation 422 may be used to move the port side solar panel 402*a* into position alongside the port side 83 of the hardtop 80 and the starboard side orientation 424 may be used to move the starboard side solar panel 402*b* into position alongside the starboard side 84 of the hardtop 80.

In their respective positions, the magnetic couplings between the solar panels 402*a*, 402*b* and the elements of the power system 400 within the hardtop 80 are aligned to magnetically couple the solar panels 402*a*, 402*b* to the marine vessel 50. In the illustrated embodiment, the port side solar panel 402*a* is magnetically and inductively coupled to the marine vessel 50 via a pair of magnetic coils 430*a*, which includes a transmitter coil in the solar panel 402*a* and a receiver coil in the body 85. of the hardtop 80 (see, e.g., FIG. 3). Similarly, the starboard side solar panel 402*b* is magnetically and inductively coupled to the marine vessel 50 via a pair of magnetic coils 430*b*, which includes a transmitter coil in the solar panel 402*b* and a receiver coil in the body 85. of the hardtop 80 (see, e.g., FIG. 3). Through the magnetic coupling between the corresponding magnetic coil pars 430*a*, 430*b*, electrical power generated by the electricity generating surfaces 434*a*, 434*b* of the solar panels 402*a*, 402*b* is inductively transferred from the solar panels 402*a*, 402*b* to the marine vessel 50.

While the solar panels 402*a*, 402*b* and power system 400 of FIG. 5 are each depicted as being magnetically coupled by one pair of transmitter and receiver magnetic coils 430*a*, 430*b*, it should be appreciated that at least one solar panel 402*a*, 402*b* may be magnetically coupled and positionally fixed to the marine vessel 50 via at least one additional magnetic coil and or at least one magnet arrangement. For example, the hardtop 80 may be configured with at least one magnet for positionally fixing at least one of the solar panels 402*a*, 402*b* on the upper surface 104 of the hardtop 80 (see, e.g., FIG. 2). Additionally or alternatively, at least one of the solar panels 402*a*, 402*b* may include at least one magnetic coil configured to positionally fix the solar panel 402*a*, 402*b* on the upper surface 104 of the hardtop 80, for example as illustrated in FIG. 4.

Figure 6:
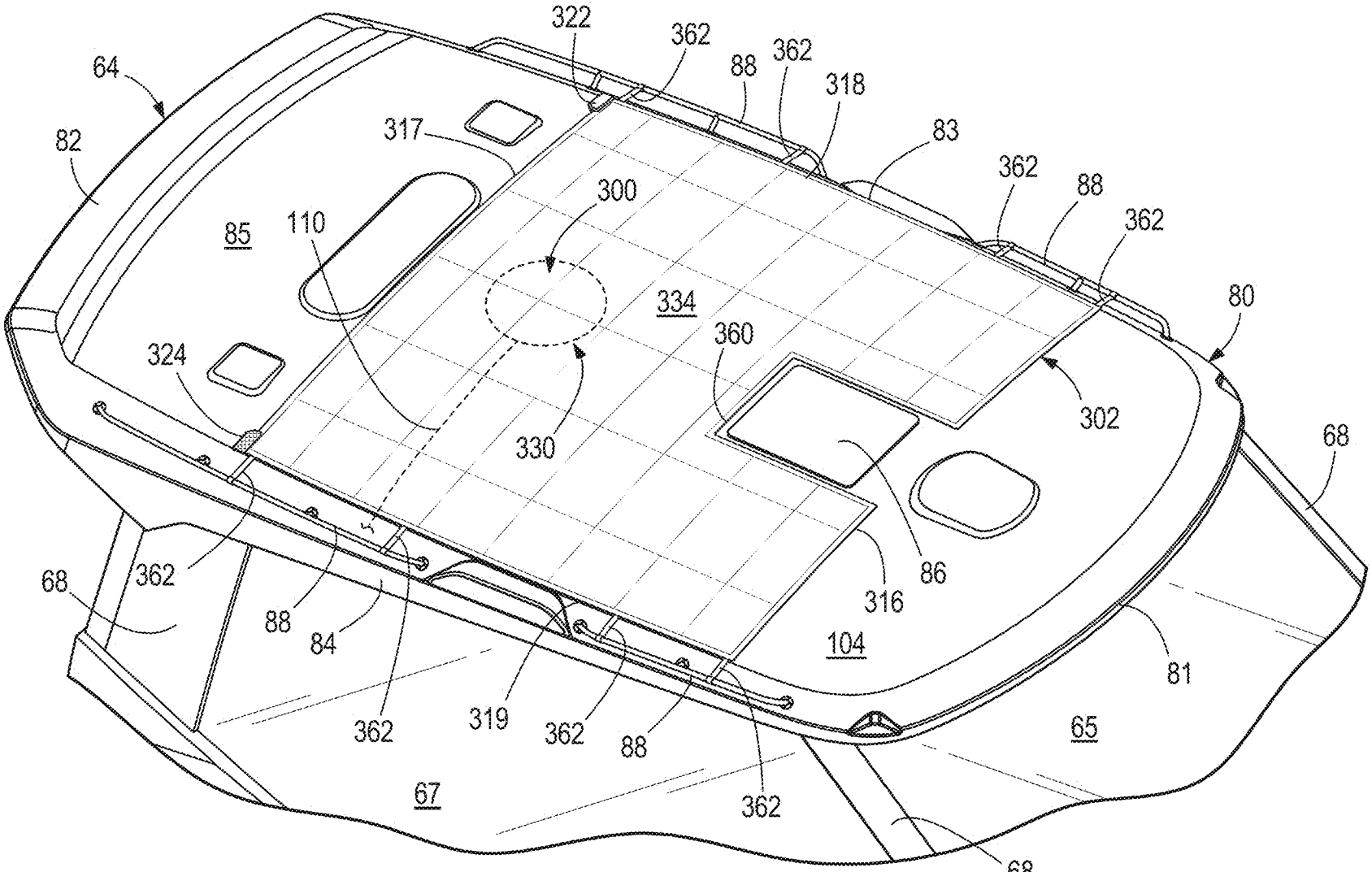
FIG. 6 is a detailed perspective view of another embodiment of a marine vessel according to the present disclosure including a power source that is mechanically coupled to the marine vessel and magnetically coupled to a power system.

In the embodiments of FIGS. 1-5, the flexible solar panels 102, 202, 402*a*, 402*b* are generally rectangular in shape. Some embodiments, however, may include a differently configured flexible solar panel. Furthermore, while the solar panels 102, 202, 402*a*, 402*b* are coupled to the hardtop 80 by the magnetic coupling therebetween, some embodiments of a solar panel may be positionally fixed relative to the upper surface 104 of the hardtop 80 non-magnetically. For example, referring to FIG. 6, some embodiments of a flexible solar panel 302 may have a shape that accommodates features of the marine vessel 50 that are positioned on the hardtop 80, and which is mechanically secured to the hardtop 80. In the embodiments of FIG. 6, the marine vessel 50 (e.g., the hardtop 80) and other related components thereof are generally the same as those described with respect to FIGS. 1-5 and will not be described again.

Referring to FIG. 6, the illustrated flexible solar panel 302 extends longitudinally between a front edge 316 and a rear edge 317 and laterally between a port edge 318 and an opposing starboard edge 319. At the front edge 316 of the solar panel 302 proximate a lateral midpoint thereof, a slot 360 is formed into the front edge 316 and extends rearwardly towards the rear edge 317. The slot 360 in the solar panel 302 is configured to accommodate the hardware 86 mounted on the upper surface 104 of the hardtop 80. In the illustrated embodiment, the slot 360 is formed around a satellite communication device (e.g., a Starlink antenna). Other embodiments, however, may be configured to extend around a different device and/or object mounted on the hardtop 80, such as a sunroof. Advantageously, the slot 360 allows in the solar panel 302 to fit around objects on the hardtop 80 so that the solar panel 302 can cover a larger area on the upper surface 104 so as to provide a larger electricity-generating surface 334. further, in addition or as an alternative to the orientation indicators 322, 324 positioned proximate the rear laterally outer corners of the solar panel 302, a user may use the slot 360 to assist in positioning the solar panel 302 on the hardtop 80. In the embodiment of FIG. 6, for example, the solar panel 302 cannot be positioned on the upper surface 104 of the hardtop 80 in any orientation other than the illustrated orientation without at least partially covering the satellite communication device 86 and/or other features located on the hardtop 80.

With continued reference to FIG. 6, the flexible solar panel 302 is magnetically electrically coupled the marine vessel 50 by a pair or magnetic coils 330, including a transmitter magnetic coil (not shown) in the solar panel 302 and a receiver magnetic coil (not shown) of the power system 300 in the hardtop 80. The magnetic coupling between the pair of magnetic coils 330 is configured as an inductive magnetic coupling that enables the wireless transfer of electrical power from the solar panel 302 to the marine vessel 50, for example as discussed in reference to FIG. 3. However, unlike the embodiments of FIGS. 1-5, the solar panel 302 of FIG. 6 is not positionally fixed on the upper surface 104 of the hardtop 80 via magnetic coupling. Instead, the flexible solar panel 302 includes a plurality of straps 362 extending laterally outward from the port side edge 318 and the starboard side edge 319 of the solar panel 302. Each strap 362 is configured to extend laterally outward from the solar panel 302 to engage one of the rails 88 that extend along the port side 83 and the starboard sides 84 of the hardtop 80. Engagement of the straps 362 with the rails 88 secures the solar panel 302 on the hardtop 80, thereby positionally fixing the solar panel 302 on the marine vessel 50. The straps 362 may be configured with snaps, loop-and-hook connectors, clamps, and/or any other type of fastener or retainer arrangement for coupling the straps 362 to the rails 88. In this manner, the solar panel 302 can be installed simply and easily in a non-permanent fashion.

While the solar panel 302 of FIG. 6 is configured with a single slot 360 configured to wrap around hardware 86 on the hardtop 80, some embodiments may be differently configured. For example, an embodiment of a solar panel may include a plurality of slots formed into the front, rear, port, and/or starboard edge(s) of said solar panel so that the solar panel extends around multiple hardware elements on the hardtop. Additionally or alternatively, a flexible solar panel may be configured with a cutout within the perimeter of the solar panel in order to accommodate a device or object on the hardtop such that said device or object is surrounded by the solar panel.

Figure 7:
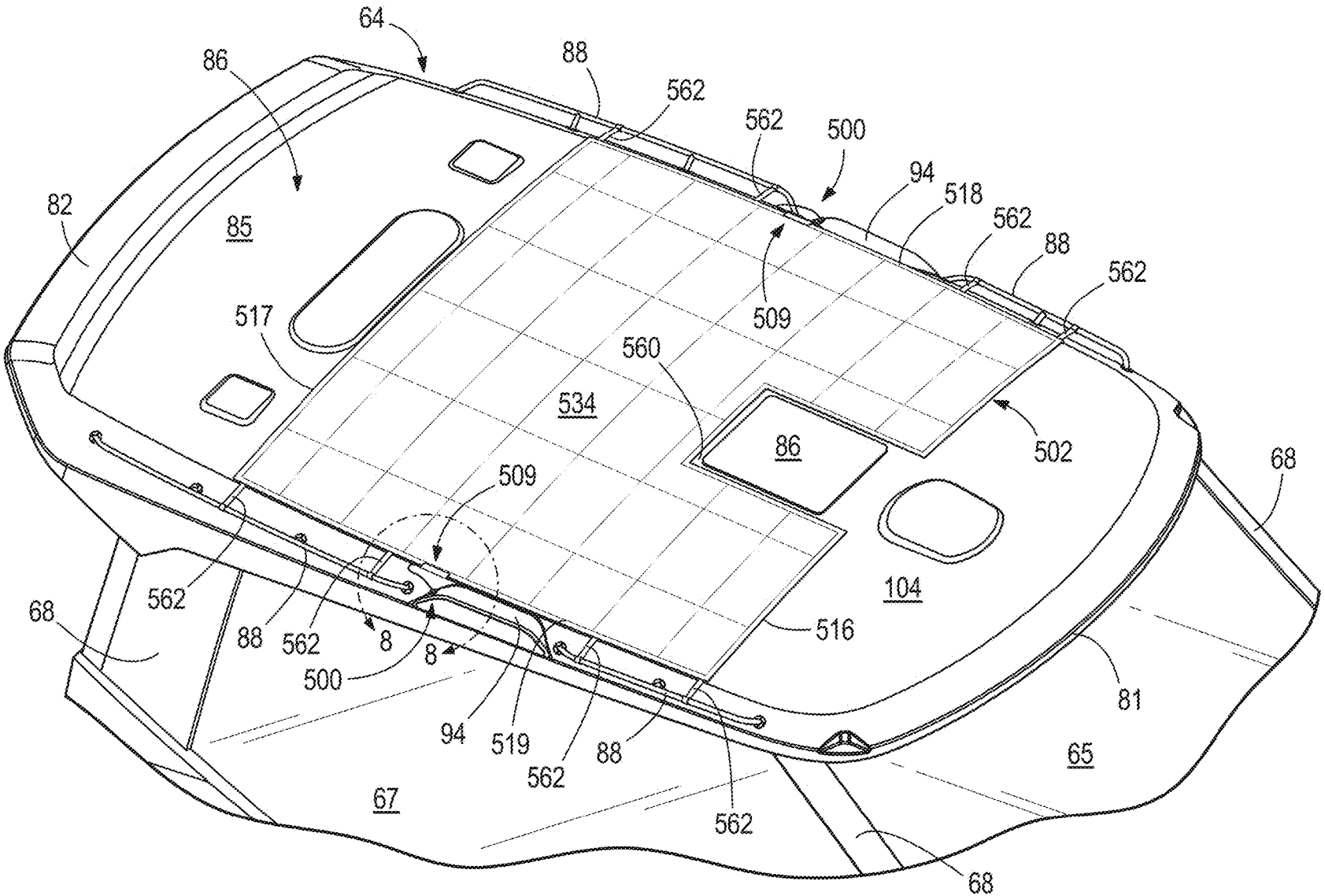
FIG. 7 is a detailed perspective view of another embodiment of a marine vessel according to the present disclosure including a power source that is mechanically coupled to the marine vessel and magnetically coupled to a power system.
Figure 8:
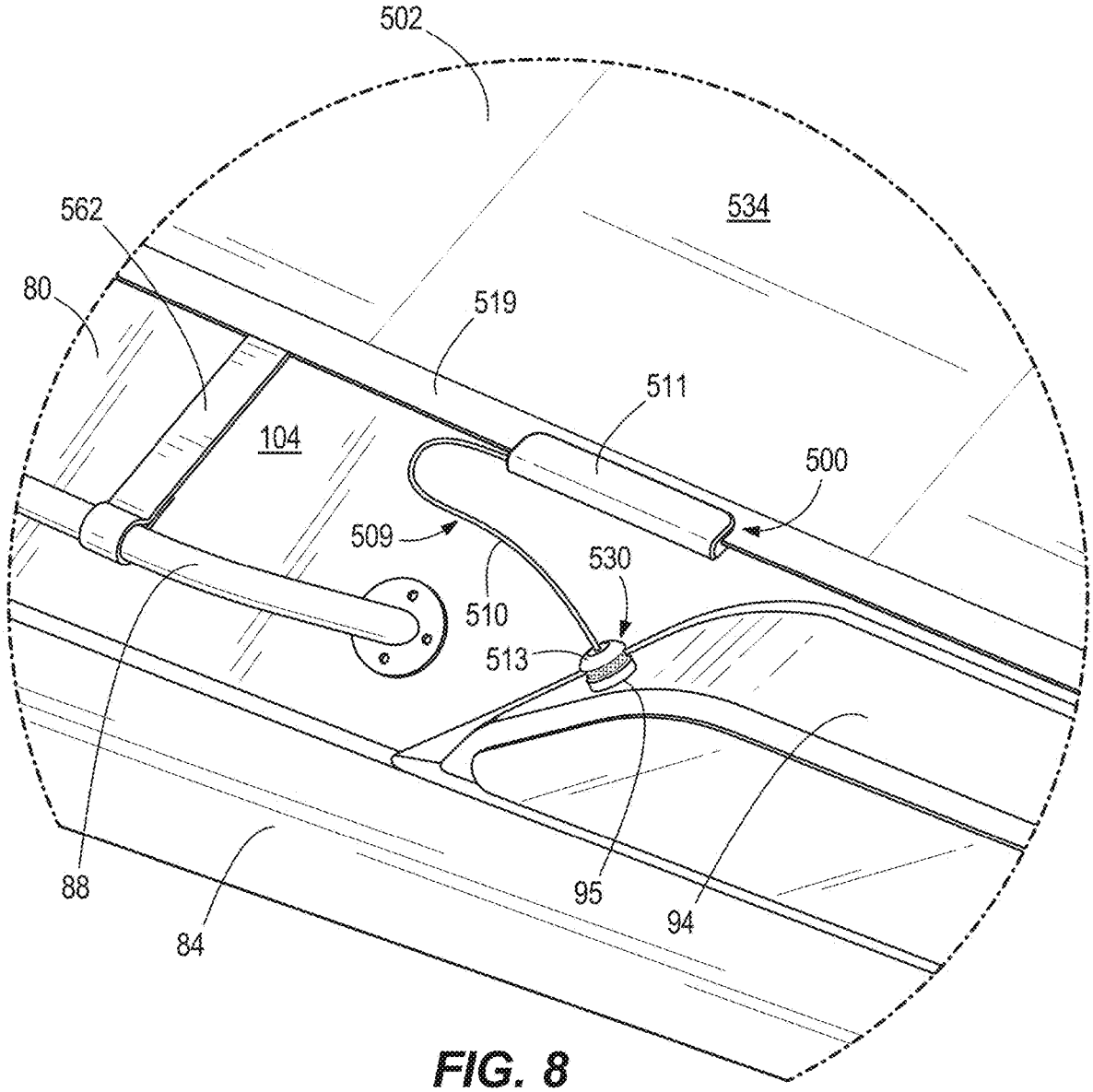
FIG. 8 is a detailed view of section 8-8, taken in FIG. 7.

In the embodiments of FIGS. 1-6, each of the illustrated solar panels 102, 202, 302, 402*a*, 402*b* is configured to provide power to the marine vessel 50 inductively via at least one pair of magnetically coupled transmitter and receiver magnetic coils that are positioned in the bodies of the solar panels 102, 202, 302, 402*a*, 402*b* and the hardtop 80, respectively. However, some embodiments of a power system for a marine vessel may be configured with a different magnetic coupling arrangement through which electrical power is provided from a power source to the marine vessel. For example, referring to FIGS. 7 and 8, an embodiment of a flexible solar panel 502 may include at least one connector 509 that extends between the solar panel 502 and the marine vessel 50. In the embodiments of FIGS. 7 and 8, the marine vessel 50 (e.g., the hardtop 80) and other related components thereof are generally the same as those described with respect to FIGS. 1-6 and will not be described again.

Referring to FIG. 7, the illustrated solar panel 502 extends longitudinally between a front edge 516 and a rear edge 517 and laterally between a port edge 518 and an opposing starboard edge 519 and, similarly to the solar panel 302 of FIG. 6, includes a slot 560 configured so that the solar panel 502 extends around the satellite communication device 86 on the hardtop 80. The solar panel 502 additionally includes a plurality of laterally extending straps 362 configured for positionally fixing the solar panel 502 on the upper surface 104 of the hardtop 80. Unlike the solar panel 302 of FIG. 6, however, the solar panel 502 and/or power system 500 of FIG. 7 includes electrical connectors 509 that extend between the port and starboard edges 518, 519 of the solar panel 502 and the hardtop 80.

Referring to FIG. 8, each electrical connector 509 includes a panel connector 511 secured to one of the lateral edges 518, 519 of the solar panel 502, a magnetic connector 513 configured to be magnetically coupled to the marine vessel 50, and a conductive wire 520 extending between the panel connector 511 and the magnetic connector 513. Magnetic connectors that retain a contact-based mating via magnetic attraction (via non-inductive energy transfer therebetween) are known and thus not discussed in great detail here. By way of example, Apple® and other electronics companies produce power adapters for laptops and other devices that are retained in position magnetically. One advantage of this type of connection is that if the cord is inadvertently tripped on while a laptop is plugged in, the magnetic attraction is easily overcome and the cord disconnects from the laptop without any harm to the cord or laptop. One example of such a commercially available product is the Apple® 45 W MagSafe 2 Power Adapter for MacBook Air. VoltSafe™ also makes magnetic connectors for connecting to shore power in a marina.

Each magnetic connector 513 is configured to removably engage and be mated with an electrical plug 95 formed on the marine vessel 50 to electrically couple the solar panel 502 to the marine vessel 50. The magnetic connectors 513 and/or the electrical plugs 95 may include a magnet (not shown) configured to retain the magnetic connector 513 in the mated position in which the magnetic connector 513 is engaged with the electrical plug 95. Thus, each pair 530 of magnetic connector 513 and electrical plug 95 is in a magnetic coupling arrangement that positionally fixes the magnetic connector 513 in the electrical plug 95. Electrical power generated by the solar panel 502 is passed to the marine vessel 50 via the magnetically coupled magnetic connector 513 and electrical plug 95.

In the illustrated embodiments, the electrical plugs 95 are each positioned on the exterior of a camera pod 94 located on the port and starboard sides 83, 84 of the hardtop 80, which can be advantageous to simplify the wiring process for the electrical plugs 95 and avoid modification to fiberglass molds for the marine vessel. Some embodiments, however, may include at least one electrical plug 95 located elsewhere on the hardtop 80 and/or another part of the marine vessel 50.

Figure 9:
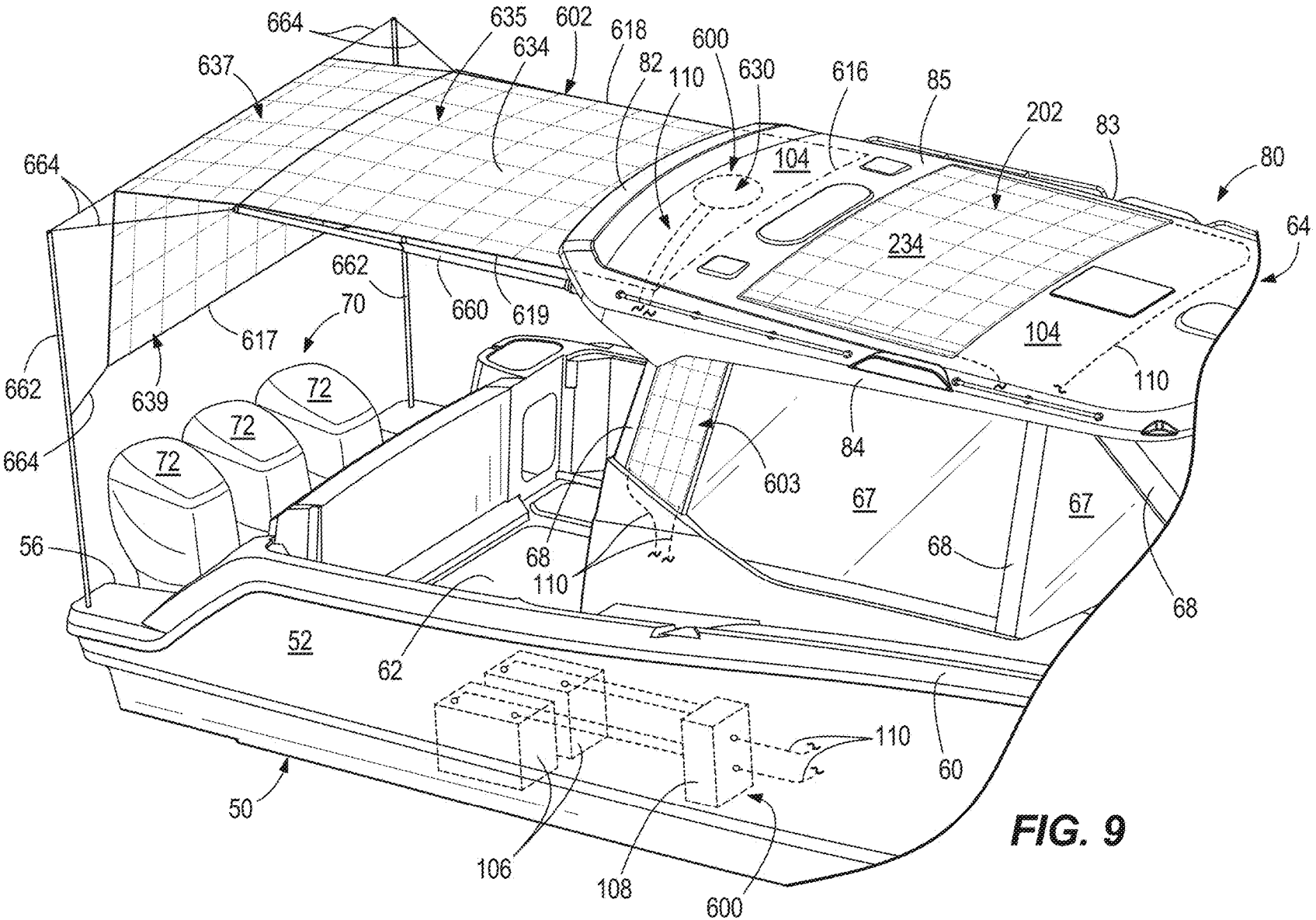
FIG. 9 is a detailed perspective view of another embodiment of a marine vessel according to the present disclosure including a deployable power source that is magnetically coupled to a power system.
Figure 10:
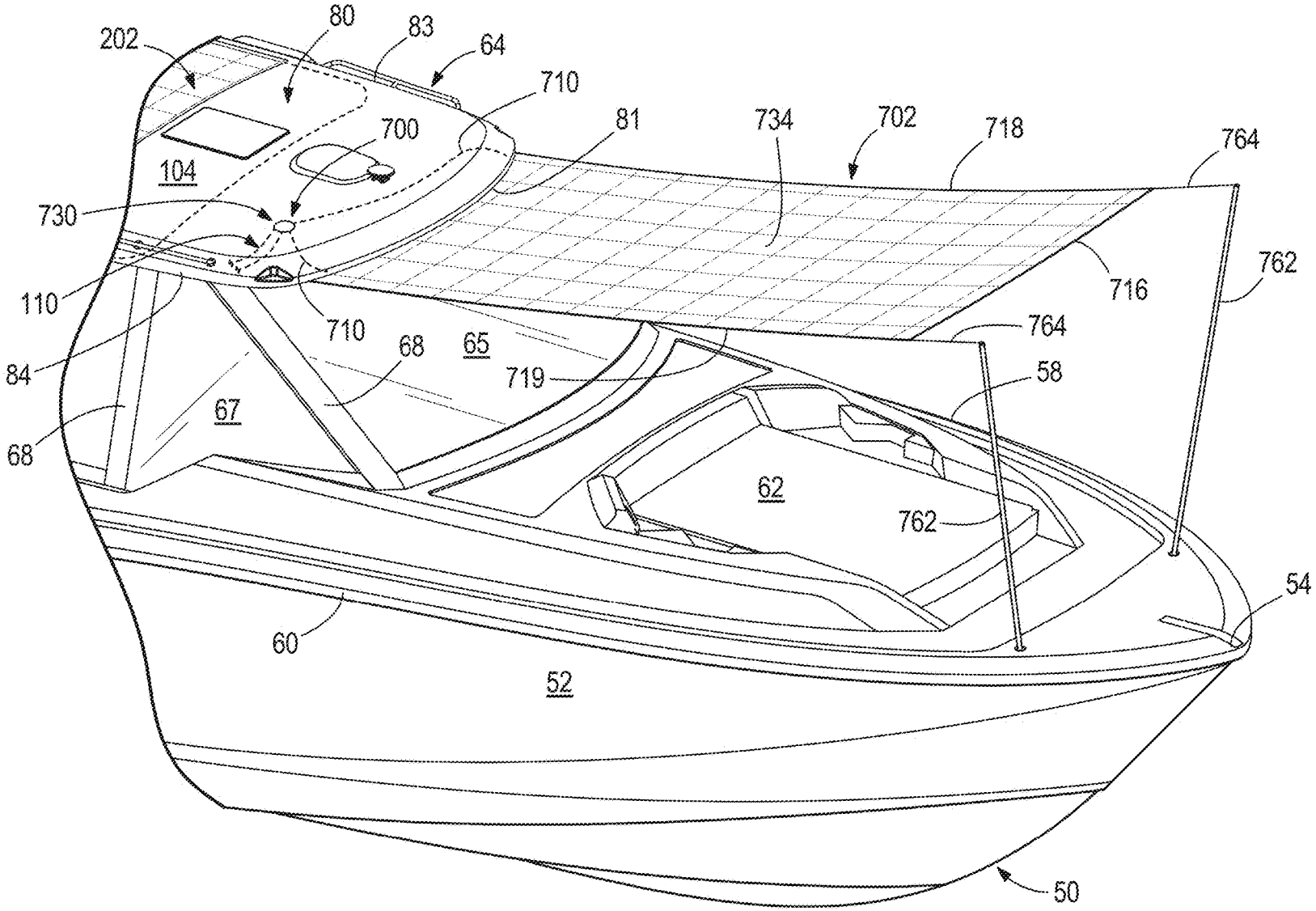
FIG. 10 is a detailed perspective view of another embodiment of a marine vessel according to the present disclosure including a deployable power source that is magnetically coupled to a power system.

In the embodiments of FIGS. 1-8, the illustrated embodiments of the solar panel 102, 202, 302, 402*a*, 402*b*, 502 are configured to be positionally fixed on the upped surface 104 of the hardtop 80 via a magnetic coupling with a power system 100, 200, 300, 400, 500. Some embodiments of a marine vessel 50 may include at least one flexible solar panel that is supported on a different surface and/or in a different manner than those of FIGS. 1-8. For example, as illustrated in FIGS. 9 and 10, an embodiment of a marine vessel 50 may be configured for use with at least one additional flexible solar panel 602, 702 that may be deployed in front of or behind the cabin 64, and/or a solar panel 603 positionally fixed at another location on the cabin 64. In the embodiments of FIGS. 9 and 10, the marine vessel 50 and other related components thereof are generally the same as those described with respect to FIGS. 1-8 and will not be described again.

Referring to FIG. 9, the illustrated marine vessel 50 includes a power source configured as a flexible solar panel 602 that can be deployed rearward from the rear side 82 of the hardtop 80. The solar panel 602 of FIG. 9 has a body that extends longitudinally between a front edge 616 and a rear edge 617 and laterally between a port edge 618 and an opposing starboard edge 619. The body of the solar panel 602 is divided into three sections: a first section 635 supported proximate the rear side 82 of the hardtop 80, a second section 637 that extends rearwardly from the first section 635, and a third section 639 that extends rearwardly and downwardly from the second section 637. The first section 635 includes the front edge 616 of the solar panel 602 which, in the illustrated embodiment, is supported on a bottom surface of the hardtop 80. Two horizontal support members 660 positioned proximate the opposing port and starboard sides 83, 84 of the hardtop 80 extend rearwardly from the rear side 82 thereof. The horizontal supports 660 extend along the port and starboard edges 618, 619 of the solar panel 602 and support the first section 635 of the solar panel 602. Vertical uprights 662 extend upwardly from the stern 56 of the marine vessel 50 proximate the port and starboard sides 58, 60 of the marine vessel 50. Flexible connectors 664 (e.g., wires, cables, ropes, etc.) extend laterally inward between the vertical uprights 662 and the port and starboard edges of the solar panel 602 to support the second and third sections 637, 639 thereof. Additionally, the illustrated embodiment includes flexible connectors 664 that extend from the top ends of the vertical uprights 662 to the distal ends of the horizontal support members 660, thereby providing additional structural support for supporting the solar panel 602.

With continued reference to FIG. 9, the first solar panel section 635 is generally horizontal between the back side 82 of the hardtop 80 and the distal ends of the horizontal support members 660. The second solar panel section 637 is also generally horizontal and extends between the first section 635 at the distal ends of the horizontal support members 660 to a flexible connector 664 that extends laterally between the upper ends of the vertical uprights 662. The third solar panel section 639 extends at a downward angle from the second section 635 at the laterally extending flexible connector 664 to the rear edge 617 of the solar panel 602, which is connected to flexible connectors 664 that extend between the rear edges of the solar panel 602 to a point on the vertical uprights 662 between the lower and upper ends thereof. Advantageously, the positions and orientations of the sections 635, 637, 639 of the solar panel 602 provide shade substantially the entire to the stern section 56 of the marine vessel 50.

Electrical power generated by the solar panel 602 may be provided to the marine vessel 50 via a magnetic coupling between the solar panel 602 and the power system 600 of the marine vessel 50. In the embodiment of FIG. 9, the solar panel 602 and the power system 600 are magnetically coupled to each other by a pair of magnetic coils 630, which includes a transmitter magnetic coil in the solar panel 602 and a receiver magnetic coil in the hardtop 80. The magnetic coupling between the pair of magnetic coils 630 is configured as an inductive magnetic coupling that enables the wireless inductive transfer of electrical power from the solar panel 602 to the marine vessel 50, for example as discussed in reference to FIG. 3. Power received by the receiver magnetic coil may be provided to the battery management system 108 and/or the batteries 106 via at least one electrical conductor 110 extending through and/or along portions of the hardtop 80 and other portions of the marine vessel 50. The illustrated design advantageously allows a marine vessel to be pre-wired to add such accessories as the solar panel 602 with the need for additional wiring and expert installation.

With continued reference to FIG. 9, embodiments of the rearwardly extending flexible solar panel 602 may be configured as a retractable solar panel 602 that is movable between an extended position (FIG. 9) and a retracted position (not shown) In the extended position most (e.g., greater than 50%, and in certain examples beyond "most" to be greater than 60%, 66%, 75%, 80%, 90%, or 95%) of the electricity-generation surfaces 634 of the solar panel 602 are exposed and operable to generate electricity. In the retracted position, the solar panel 602 may be retracted under the hardtop 80 so that the solar panel 602 is covered and protected from wear and any potentially damaging environmental conditions. The retracted configuration also allows the user to stow the solar panel 602 when the batteries 106 are fully charged and/or it is preferred to not have a cover above the marine vessel 50, whether to enjoy the sunshine or provide additional clearance for fishing, for example.

Some embodiments of a deployable solar panel 602 may be configured with a retractor device (not shown) that assists a user in retracting the solar panel 602, or which automatically retracts the solar panel 602 into the retracted position. For example, the front edge 616 of the solar panel 602 may be supported on a retractor device mounted on the bottom surface of the hardtop 80. Some embodiments of a retractor device may be configured as a retractor drum assembly (not shown) that is configured to automatically roll up the flexible solar panel 602. An embodiment of a retractor drum assembly may include a rotating drum onto which the flexible solar panel may be wrapped and a biasing device for biasing the drum to rotate in a direction that winds the solar panel 602 around the drum. A retractor drum assembly may function like a traditional window shade or pull-down projector screen. One example of a commercially available product that may be used as the retractor drum assembly is the EZ Rise Cordless Shade 1½" Spring with Slow Rise Damper produced by the Rowley Company of Gastonia, North Carolina. A user may move the solar panel 602 from the retracted position to the extended position by pulling the rear edge 617 away from the hardtop 80, thereby unrolling the solar panel 602 from the retractor drum. The solar panel 602 may be returned to the retracted position by allowing the retractor device to automatically retract the solar panel, for example by a spring biasing device and/or a motor, or manually by a user.

As previously mentioned, a marine vessel 50 may additionally of alternatively include a solar panel 603 that is supported on a different surface of the marine vessel 50, for example on the cabin 64. Referring to FIG. 9, the illustrated marine vessel 50 includes a flexible solar panel 603 that is positionally fixed on the rear support column 68 of the cabin 64 on the starboard side 60 of the marine vessel 50. Embodiments of the laterally positioned solar panel 603 may be positionally fixed on the support column 68 via a magnetic coupling arrangement and/or a non-magnetic mounting arrangement. In some embodiments, the lateral solar panel 603 may be configured to provide electrical power to the marine vessel 50 wirelessly via an inductive magnetic coupling, while some embodiments may include a magnetic connector, for example an arrangement similar to the electrical connector 509 arrangement of FIGS. 7 and 8.

While FIG. 9 shows a marine vessel 50 with a single lateral solar panel 603 on the rear starboard support column 68 of the cabin 64, some embodiments may include at least one additional lateral solar panel. For example, a lateral solar panel may be positioned on a different support column 68 on either the port or starboard side 58, 60 of the marine vessel 50. Additionally or alternatively, an additional solar panel may be positionally fixed on a different surface, for example on the deck and/or the hull 52 of the marine vessel 50.

FIG. 10 illustrates another embodiment of a deployable solar panel 702 that extends in a forward direction from the front side 81 of the hardtop 80. The forward deployable solar panel 702 of FIG. 10 has a body that extends longitudinally between a front edge 716 and a rear edge (not shown) and laterally between a port edge 718 and an opposing starboard edge 719. The rear end of the solar panel 702 is supported on the lower surface of the hardtop 80 proximate the front side 81 thereof. Port and starboard side vertical uprights extend upwardly from opposing sides of the bow section 54, and flexible connectors 764 extend from the upper end of each vertical upright 762 to a corresponding port or starboard corner of the solar panel 702 along the front edge 716 thereof. Thus, the rear end of the solar panel 702 is supported by the hardtop 80 and the front edge 716 is supported by the vertical uprights 762 and flexible connectors.

Similarly to the deployable solar panel 602 of FIG. 9, the solar panel 702 of FIG. 10 can be moved into and between an extended position (FIG. 10) and a retracted position (not shown). In the extended position, the solar panel 702 is configured to provide shade substantially the entire to the bow section 5. of the marine vessel 50. Further, as with the deployable solar panel 602 of FIG. 9, most (e.g., greater than 50%, and in certain examples beyond "most" to be greater than 60%, 66%, 75%, 80%, 90%, or 95%) of the electricity-generation surface 734 of the solar panel 702 is exposed and operable to generate electricity.

Electrical power generated by the solar panel 702 may be provided to the marine vessel 50 via a magnetic coupling between the solar panel 702 and the power system 700 of the marine vessel 50. Similarly to the embodiments of FIGS. 7 and 8, the solar panel 702 and the power system 700 may be electrically connected to each other by a connector pair 730, which includes a magnetic connector (not shown) and electrical plug (not shown) that may be in a magnetic coupling arrangement that positionally fixes the magnetic connector in the electrical plug. In such an embodiment, at least one electrical conductor 710 may extend between the solar panel 702 and the connector pair 730, and electrical conductors 110 of the marine vessel 50 transfer the electrical power generated by the solar panel 702 to the battery management system 108 and/or the batteries 106. Additionally or alternatively, the forward deployable solar panel 702 may be configured with a transmitter magnetic coil configured to inductively provide power to the marine vessel 50 via a receiver magnetic coil located in the hardtop, as discussed in reference to FIG. 9.

In the retracted position, the solar panel 702 may be retracted under the hardtop 80 so that the solar panel 702 is covered and protected from wear and any potentially damaging environmental conditions. The retracted configuration also allows the user to stow the solar panel 702 when the batteries 106 are fully charged and/or it is preferred to not have a cover above the marine vessel 50. Some embodiments of the forward solar panel 702 may be configured with a retractor device (not shown) that assists a user in retracting the solar panel 702, or which automatically retracts the solar panel 702 into the retracted position. For example, similar to the rear deployable solar panel 602, the rear edge of the forward deployable solar panel 702 may be supported by a retractor device mounted on the hardtop 80. Some embodiments of a retractor device may be configured as a retractor drum assembly (not shown) that is configured to automatically roll up the flexible solar panel 702, as previously discussed. Some embodiments, however, may be configured with a different type of retractor device, which may be manual or automatic.

This written description uses examples to disclose the invention, including the best mode, and also to enable any person skilled in the art to make and use the invention. Certain terms have been used for brevity, clarity, and understanding. No unnecessary limitations are to be inferred therefrom beyond the requirement of the prior art because such terms are used for descriptive purposes only and are intended to be broadly construed. The patentable scope of the invention is defined by the claims and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. A marine vessel configured for removably magnetically physically coupling a power source thereto, the power source being configured to generate electrical power, the marine vessel comprising:

a power system configured to receive electrical power from the power source when the power source is magnetically physically coupled to the marine vessel; and a surface configured to support the power source while the power source is magnetically physically coupled to the marine vessel and providing the electrical power thereto via a magnetically retained electrical connection, wherein the power source is removable from the marine vessel a least in part by overcoming the magnetic physical coupling and the magnetically retained electrical connection therebetween.

2. The marine vessel according to claim 1, wherein the power source is positionally fixed relative to the surface via the magnetic coupling between the power source and the marine vessel.

3. The marine vessel according to claim 2, wherein the power source and the marine vessel comprise magnetic coils through which the electrical power from the power source is provided to the marine vessel inductively.

4. The marine vessel according to claim 1, wherein the surface of the marine vessel comprises a magnet configured to magnetically retain the electrical connection with the power source.

5. The marine vessel according to claim 2, wherein the surface of the marine vessel comprises a magnet for magnetically physically coupling the power source thereto, wherein the magnet remains with the surface when the power source is removed therefrom.

6. The marine vessel according to claim 1, wherein the surface has a recessed section configured to position the power source at least partially therein with the power source is supported by the surface so as to assist in positionally fixing the power source relative to the marine vessel.

7. The marine vessel according to claim 1, wherein the power source comprises a solar panel.

8. The marine vessel according to claim 1, wherein the surface comprises a fixed hardtop of the marine vessel.

9. The marine vessel according to claim 8, wherein the power source comprises a solar panel.

10. The marine vessel according to claim 1, wherein the surface is non-planar and is configured to support a flexible solar panel as the power source thereon.

11. The marine vessel according to claim 1, wherein the electrical power is provided from the power source to the marine vessel via magnetic induction.

12. The marine vessel according to claim 1, wherein the power source and the marine vessel comprise magnetic coils, wherein the magnetic coupling comprises inductive coupling between the magnetic coils such that the electrical power is provided to the marine vessel therethrough.

13. The marine vessel according to claim 12, wherein the surface comprises a rigid material, and wherein the magnetic coil of the marine vessel is at least partially recessed within the rigid material.

14. The marine vessel according to claim 12, wherein the surface has a recessed section configured to position the power source at least partially therein while the power source is supported by the surface so as to assist in aligning the magnetic coils of the power source and the marine vessel, respectively.

15. The marine vessel according to claim 1, wherein the magnetically physically coupling the power source automatically magnetically retains the electrical connection therewith.

16. The marine vessel according to claim 15, wherein the marine vessel is configured for also positionally fixing the power source relative to the surface non-magnetically.

17. A marine vessel configured for removably magnetically coupling a power source thereto, the power source being configured to generate electrical power, the marine vessel comprising:

a power system configured to receive electrical power from the power source when the power source is coupled to the marine vessel;

magnetic coils through which the power source and the marine vessel communicate the electrical power; and a surface configured to support the power source while the power source is providing the electrical power thereto, wherein the power source is removable from the marine vessel a least in part by overcoming the coupling therebetween, and wherein the power source is prevented from being supported by the surface in a position in which the magnetic coils of the power source and the marine vessel are unaligned with each other.

18. A marine vessel configured for removably magnetically coupling a power source thereto, the power source being configured to generate electrical power, the marine vessel comprising:

a power system configured to receive electrical power from the power source when the power source is coupled to the marine vessel;

magnetic coils through which the power source and the marine vessel communicate the electrical power; and a surface configured to support the power source while the power source is providing the electrical power thereto, wherein the power source and the marine vessel have a predetermined polarity for being electrically coupled together, and wherein the surface and/or the power source are configured such that when the power source is prevented from being supported by the surface in a position in which the power source would be electrically coupled with the marine vessel in a polarity opposite than the predetermined polarity.

19. A marine vessel configured for removably coupling a solar panel thereto, the solar panel being configured to generate electrical power, the marine vessel comprising:

a hardtop having a magnet and a magnetic coil each fixed relative thereto, wherein the magnet is configured to positionally fix the solar panel to the hardtop such that the magnetic coil of the marine vessel is aligned with a magnetic coil of the solar panel; and wherein the electrical power generated by the solar panel is provided to the marine vessel via inductive coupling of the marine vessel and the solar panel when the solar panel is positionally fixed to the hardtop.

20. A marine vessel with a power system, the marine vessel comprising:

a solar panel having solar cells configured to generate electrical power, the solar panel further having a first induction coil electrically coupled to the solar cells; and a hardtop comprising a rigid upper surface and a second induction coil, the second induction coil being electrically coupled to the power system of the marine vessel, wherein the hardtop is configured to support the solar panel on the upper surface thereof; and wherein the hardtop is configured such that when the solar panel is supported on the upper surface the electrical power generated by the solar panel is provided to the power system of the marine vessel via magnetic induction between the first induction coil and the second induction coil.

* * * * *